United States Patent [19]

Kukkonen et al.

[11] Patent Number: 5,059,131

[45] Date of Patent: Oct. 22, 1991

[54] RESILIENT CONNECTOR FOR RADIO FREQUENCY SIGNALS

[75] Inventors: Osmo Kukkonen; Antero Väyrynen, both of Salo, Finland

[73] Assignee: Nokia Mobile Phones Ltd., Salo, Finland

[21] Appl. No.: 495,613

[22] Filed: Mar. 14, 1990

[30] Foreign Application Priority Data

Apr. 12, 1989 [FI] Finland ..... 891745

[51] Int. Cl.[5] ..... H01R 23/72; H01R 9/09

[52] U.S. Cl. ..... 439/78; 439/65; 439/81

[58] Field of Search ..... 439/55, 78, 81, 92, 439/824

[56] References Cited

U.S. PATENT DOCUMENTS

| | | | |
|---|---|---|---|
| 3,248,779 | 11/1963 | Yuska et al. | 439/78 |
| 3,745,510 | 7/1973 | Mallon | 439/55 |
| 3,848,947 | 11/1974 | Jambor | 439/78 |
| 4,764,848 | 8/1988 | Simpson | 439/81 |

FOREIGN PATENT DOCUMENTS

| | | | |
|---|---|---|---|
| 1208375 | 1/1966 | Fed. Rep. of Germany | 439/55 |
| 2028879 | 10/1970 | France | 439/55 |
| 2503977 | 10/1982 | France | 439/55 |
| 0906046 | 2/1982 | U.S.S.R. | 439/55 |
| 0932210 | 7/1963 | United Kingdom | 439/55 |
| 1150233 | 4/1969 | United Kingdom | 439/55 |

*Primary Examiner*—Larry I. Schwartz
*Assistant Examiner*—Kevin J. Carroll
*Attorney, Agent, or Firm*—Darby & Darby

[57] ABSTRACT

A resilient connector for radio frequency signals comprises contact pins (1–3) perpendicularly movable in holes (12–14) made into a printed board (10). Each pin is connected to a circuit through a signal spring (4–6) with one end rubbing against the pin (1–3). The contact between the pin and an other connector is secured by a helical spring (7–9) pushing the pin away from the board (10).

5 Claims, 1 Drawing Sheet

RESILIENT CONNECTOR FOR RADIO FREQUENCY SIGNALS

BACKGROUND OF THE INVENTION

The invention relates to a connector for radio frequency signals mounted on a printed board.

Usually coaxial connectors are used to connect radio frequency signals, which are carried on a central contact of the connector. The signal contact is then coaxially surrounded by a cylindrical contact part providing the grounding and the contact for the sheath. A connection comprises two coaxial connectors, a male and a female connector exactly fitting into each other. A connector of this type can also be mounted on a printed board. The known connectors are reliable but expensive due to their construction. The connection of the signal circuits of two printed boards through these connectors further requires an accurate mechanical fitting and a somewhat resilient construction of the mounting, which increases the cost of the connector.

The applicant has developed a surface connector, in which the contacts consist of the printed conductors of the printed board, so that the contacts for the ground and the sheath are symmetrically situated on both sides of the signal contact. The contacts are located on the surface of the printed board or on an edge of the printed board, perpendicular to the surface of the board. One of the connectors of the connection should be a planar connector, the contacts of which can resiliently yield so that the possibility of movement on one hand compensates for any inaccuracies and so that the spring force on the other hand ensures an adequate contact force between the connectors. It should be possible to connect such a new connector against the surface connector, either in the direction of the plane of the board or perpendicular to the board.

SUMMARY OF THE INVENTION

The object of the present invention is to provide such a resilient connector, which makes possible the described connection to a surface connector.

Preferably the sheath contact means are located symmetrically on both sides of the signal contact means, resiliently yielding in the direction of said plane when the connector is connected to the other connector of the connection.

According to an embodiment the contact means are contact pins, which can move in holes made in the board, each pin being connected to circuits on the printed board through signal springs rubbing the pin with one end, the other end of the spring being connected to a printed circuit, and the contact between the pin and the contact means of the other connector of the connection being secured by another contact spring.

According to another embodiment the contact means are contact springs with one end connected to a printed circuit, the other end having a pin-like projection, the contact between the projection and the contact means of the other connector being secured by the contact spring.

The contact means of the connector according to the invention are dimensioned and located at a mutual distance such that the impedance level of the connector is low, preferably in the range between 50 and 150 ohms.

BRIEF DESCRIPTION OF THE DRAWING

The invention will be described in more detail below referring to the enclosed drawing, in which.

DESCRIPTION OF THE PREFERRED EMBODIMENT

Figure 1:
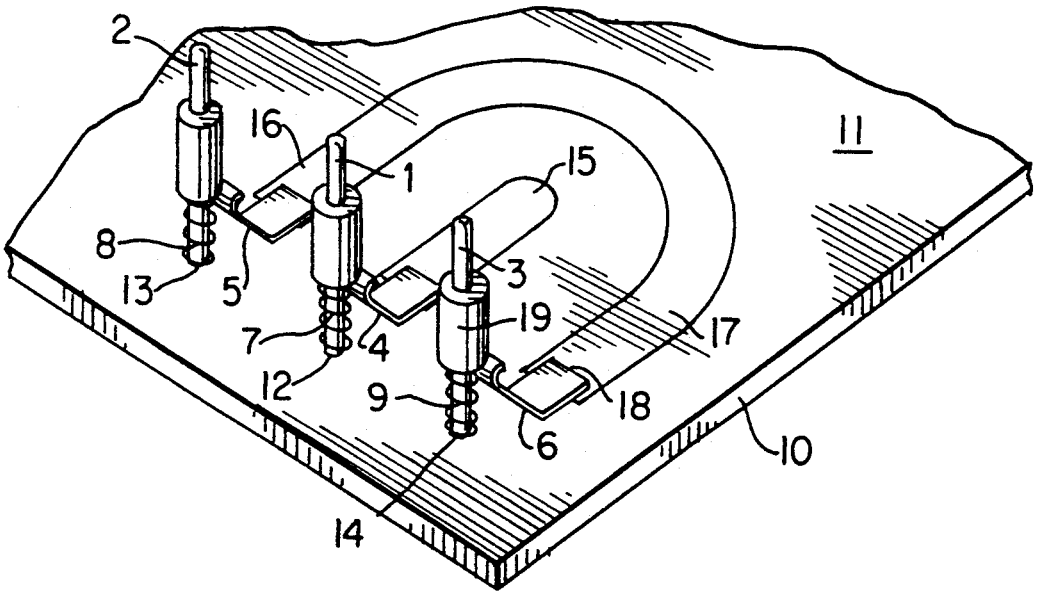
FIG. 1 is a diagrammatic perspective view of the a printed board resilient connector according to the invention.

In FIG. 1 a printed board 10 is provided with a resilient connector with contacts formed by contact pins 1–3 mounted in corresponding holes 12–14, which are drilled through the printed board so that the pins can move substantially perpendicular to the plane 11 of the board. The pin 1 is the signal contact. The contacts 2 and 3 are located symmetrically on both sides of the signal contact and extend into contact with each other. The signal and ground connections between the conductors 15–17 on the board and the pins 1–3 is provided by the springs 4–6. The springs comprise a strip of metal with one end 18 (shown for spring 6 only) which is electrically conductive and connected to the conductors 15–17, e.g., by soldering. The other end rubs the corresponding pin 1–3. The contact pin may be provided with a first portion extending out of the respective hole and a second portion 19 of larger diameter which rubs against the springs 4–6.

The contact between the contact pin and the contact means of the other connector of the connection is secured with a helical spring 7–9 pushing the pin away from the board 10.

The other connector of the connection, not shown in the drawings, comprises conductors printed on, for example, a second board so that the printed contacts of the ground and sheath are located symmetrically on both sides of the signal contact, and so that the planar contacts lie in the same plane forming a surface connector. The surface connector is described in the U.S. patent application No. 493,612. The contact pins 1–3 according to the present invention will resiliently contact the contacts of the surface connector, so that the possibility of movement on one hand compensates for any inaccuracies and so that the spring force of the helical springs 7–9 on the other hand ensures an adequate contact force between the connectors.

Figure 2:
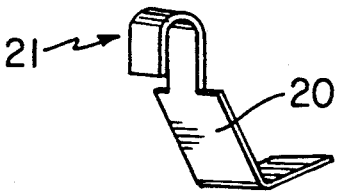
FIG. 2 shows a diagrammatic perspective view of a connector spring of another embodiment, replacing the contact pin and the signal spring according to FIG. 1.

The example shown in FIG. 2 illustrates another embodiment of the connector according to the invention with contact springs 20, of which there would be three in a connector according to FIG. 1. The springs 20 replace the contact pins 1–3, the helical springs 7–9 and the springs 4–6. One end of the contact spring is connected to a corresponding printed circuit 15–17, the other end has a hook-shaped projection 21. The contact between the projection and the contact means of the other connector is secured by the spring force of the contact spring 20 itself, as the connectors are connected in a pressing relationship against each other.

It is naturally conceivable, that the plane of movement of the contact pins 1–3 described above, through appropriate mechanical arrangements, may be provided in parallel with the plane of the printed board. The springs 4–6 can be formed in different ways, e.g. as a spring with a U-form holding the contact pin. With an appropriate design of the contact spring 20, the hook-shaped projection 21 can also perform the resilient movement of the contact in the printed board plane.

The resilient connector according to the invention constitutes a connector meeting the requirements for radio frequency signals, primarily due to its symmetrical construction. The contact pins 1–3 may thus be dimensioned (width, thickness, and distances between the conductors) according to methods well known in the art, so that the specific impedance or impedance level of the connector will be e.g. 50 ohms, which is the generally used impedance level on radio frequencies. The symmetrical construction will also reduce (or prevent) stray coupling.

The inventive connector described above may in principle also be realized so that the contact pins are duplicated, or so that there are a plurality of them, depending on the requirements of the circuit design and/or of the mechanical conditions.

We claim:

1. A resilient connector, comprising:

a printed circuit board having a planar surface;

contact means including a ground contact having two legs which extend into contact with each other on said planar surface, and an elongated contact for transmission of radio frequency signals, said elongated contact extending on said planar surface between said legs and being spaced from said ground contact;

resilient means for connecting said contact means with another connector, said resilient means including resilient elements having one end secured in contact respectively with said elongated contact and said ground contact, said resilient elements also having another end which is free for effecting contact resiliently with said another connector arrangement, said another end of said resilient elements extending to a location out of the plane of said planar surface, said printed circuit board having holes;

movable contact pins in said holes; and means for biasing said pins in a direction away from said board for effecting contact of said pins with contact means of the another connector, said pins being movable against the biasing means further into the holes, said another end of said resilient elements being in contact with said pins, respectively.

2. A connector as in claim 1, wherein said another end of at least one of said resilient elements has a hooked shape.

3. A connector as in claim 1, wherein said contact means provides an impedance within the range of 50 to 150 ohms.

4. A connector as in claim 1, wherein said contact pins biasing means and said resilient elements each project out of the plane of said planar surface.

5. A connector as in claim 1, wherein said contact pins each have a first portion extending out of said holes and around which is said biasing means, said contact pins also having a second portion of a larger diameter than said first portion so as to have an underside that extends radially outside of said first portion, said another end of said resilient elements contacting against said underside of said second portion.

* * * * *